US005141055A

United States Patent [19]

Chien et al.

[11] Patent Number: 5,141,055

[45] Date of Patent: Aug. 25, 1992

[54] METHOD AND APPARATUS FOR CONTROLLING THE MASS FLOW RATE OF STEAM IN STEAM DISTRIBUTION SYSTEMS

[75] Inventors: Sze-Foo Chien, Houston; Joseph A. Anderson, Richmond; Clifford L. Redus, Peterculter; James W. Scott, Katy; Peter L. Sigwardt, Houston, all of Tex.

[73] Assignee: Texaco Inc., White Plains, N.Y.

[21] Appl. No.: 729,257

[22] Filed: Jul. 12, 1991

[51] Int. Cl.[5] ..... E21B 43/24

[52] U.S. Cl. ..... 166/272; 166/57

[58] Field of Search ..... 166/272, 303, 57, 90, 166/91

[56] References Cited

U.S. PATENT DOCUMENTS

| | | | |
|---|---|---|---|
| 4,540,050 | 9/1985 | Huang et al. | 166/272 |
| 4,577,688 | 3/1986 | Gassmann et al. | 166/272 X |
| 4,640,355 | 2/1987 | Hong et al. | 166/272 X |
| 4,958,684 | 9/1990 | Nguyen et al. | 166/272 X |

*Primary Examiner*—William P. Neuder

*Attorney, Agent, or Firm*—Robert A. Kulason; James J. O'Loughlin; Robert B. Burns

[57] ABSTRACT

Method and Apparatus for injection steam of know quality into a subterranean reservoir containing hydrocarbon fluids, to enhance or stimulate production of said fluids through a production well. Production stimulating steam from a pressurized source is injected into the reservoir by way of a critical flow venturi and an injection well, in a manner to maintain the steam at a desired pressure and flow rate. The venturi's constricted throat is formed as a function of the stimulating steam's original characteristics.

10 Claims, 2 Drawing Sheets

METHOD AND APPARATUS FOR CONTROLLING THE MASS FLOW RATE OF STEAM IN STEAM DISTRIBUTION SYSTEMS

BACKGROUND OF THE INVENTION

In geographical areas of the earth where the production of subterranean hydrocarbons has become difficult due to the nature of the oil or natural subterranean conditions, the use of stimulating methods is well known in the industry. One such method identified more particularly as steam injection or steam drive, relates to a method wherein steam is injected directly into the hydrocarbon containing segment of the substrate.

The injected steam is of necessity at a sufficient pressure to overcome the natural pressure which would ordinarily be exerted on the contained hydrocarbon in liquid or gaseous form. The stimulating steam injected into the reservoir function to drive the hydrocarbon toward an area of lower pressure such as a production well or wells positioned at a distance from the injection well.

In principle, the steam stimulating method utilizes steam which is usually generated at a remote point and is delivered by piping to the respective well heads of the injection wells.

While the steam injection procedure is familiar to the industry, the degree of efficiency with which it operates is dependent to a large degree on the quality and the flow rate of the steam being injected. It may also depend on the capability of the substrate to be heated, and on the contained hydrocarbon to flow toward one or more of the production wells.

The prior teachers that one presently practiced method for controlling steam injection rate to a well or wells, is through use of a critical flow choke bean. This apparatus is positioned immediately upstream of the well head and operates at a critical flow condition. Thus, the steam's mass flow rate depends on the steam supply pressure and on the size of the choke bean. For a given steam pressure, the resulting flow rate will in effect depend on the size of the choke bean.

One detriment to the use of such a flow rate control device is the excessive pressure drop required across the choke bean to achieve a critical flow condition. This pressure drop is found in practice to be approximately 45% to 55% of the steam pressure upstream of the bean. Stated otherwise, steam pressure immediately downstream of the choke bean will be only 45% to 55% of the choke inlet steam pressure. Thus, if reservoir pressure is relatively high, or the steam supply pressure isn't high enough, the choke bean serves only as a flow restriction and cannot function to determine flow rate.

In summary, a primary fault endemic to the use of any choke bean as a flow rate control device in the steam injection or steam stimulating process, is the severe decrease in steam pressure realized across the bean. Operationally, when a relatively high reservoir pressure is encountered, the steam upstream pressure must be commensurably increased. However, such an increase in steam pressure will result in an increase in production costs associated with steam generation and distribution.

BRIEF DESCRIPTION OF THE INVENTION

Toward overcoming this stated difficulty in hydrocarbon production enhancement, the present invention addresses a novel method for, and an apparatus to control the flow rate of steam which is injected into a reservoir, while minimizing pressure loss experienced through the flow controlling device.

The novel apparatus includes primarily a critical flow venturi into which the pressurized steam flow is introduced, and through which the entire flow of injected steam must pass. The venturi is characterized by an elongated multi-segment flow passage formed by sequential flow passage segments, communicated through a constricted throat.

The first or upstream segment of the venturi is characterized by a convergent nozzle in which the cross sectional area of steam flow passage is progressively reduced to a relatively small or constricted throat.

Downstream of the constricted throat a divergent nozzle characterized by a small cone angle, receives the steam. The cross sectional flow area through this segment is progressively and uniformly increased. The divergent nozzle terminates at a discharge port adjacent to the close entry of the steam into an injection well (or the wells' string).

Use of a critical flow venturi in the steam injection process represents an economic advantage since it is designed to function utilizing a well head steam pressure only slightly greater, within the range of about 5% to 25%, than the pressure of the steam which enters the injection well.

It is an objective of the invention therefore to provide a steam injection apparatus and method wherein a pressurized steam flow is delivered from a source thereof, into a subterranean reservoir without realizing a substantial reduction in the steam's supply pressure.

Figure 1:
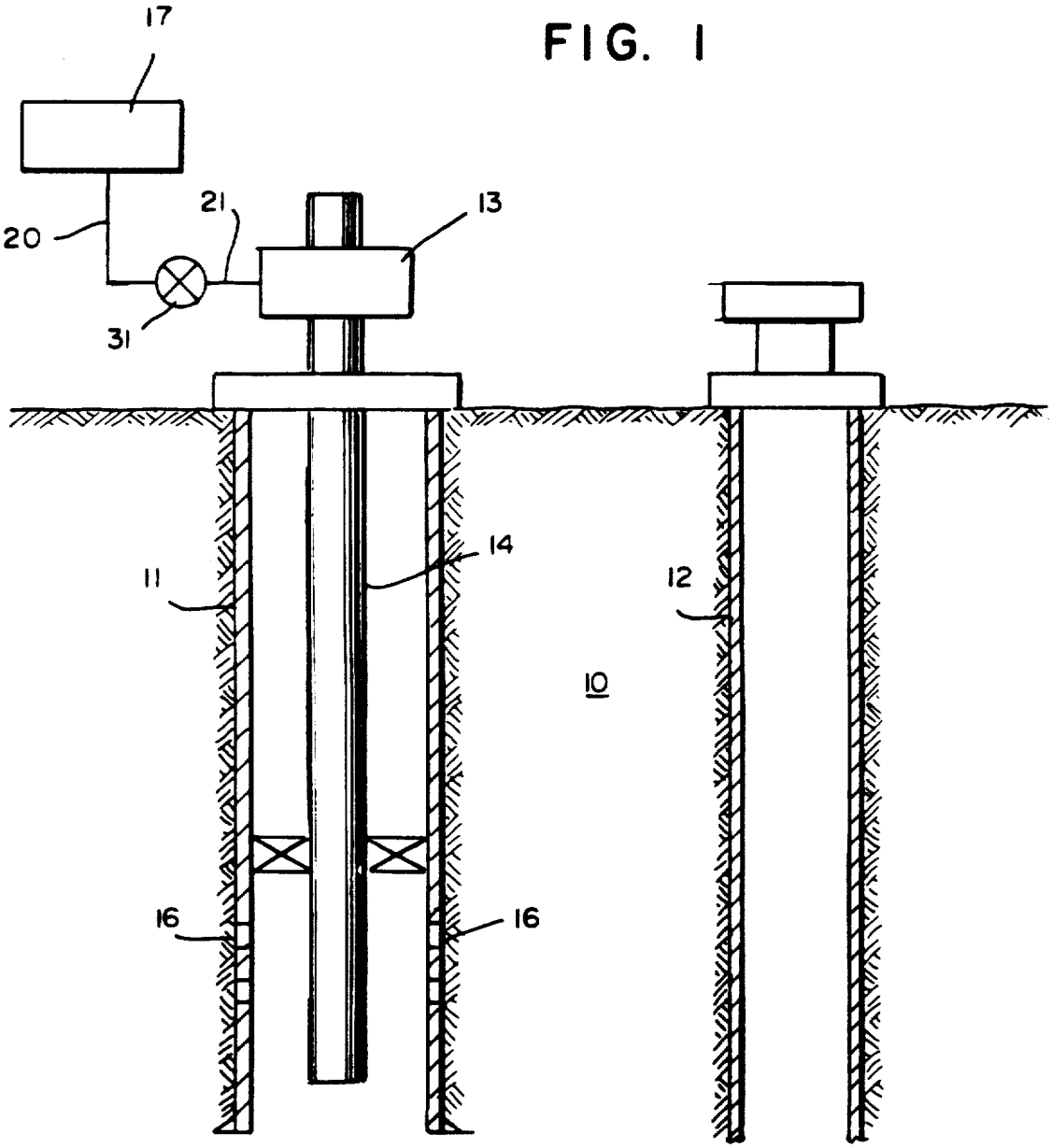
FIG. 1 represents an environmental cross-sectional view of a steam injection well embodying the present flow control apparatus, together with a production well, both wells penetrating a subterrarean reservoir.

To illustrate the invention, FIG. 1 embodies a vertical cross-sectional view of a substrate or reservoir 10 which contains a hydrocarbon fluid under gas reservoir pressure. To stimulate production of the contained hydrocarbon from the reservoir an injection well is drilled and completed in the formation at a predetermined distance from one or more production wells 12.

It is appreciated that as a matter of practice, the respective injection and production wells can be altered in function merely by the use of particular well head equipment. Alternately, the direction of steam injection can be adjusted such that the steam front created by the injection into the reservoir moves toward any one or more of the production wells.

Injection well 11 is provided with a well head 13 which communicates with a tubing string 14. The tubing string 14 is perforated at 16 or at a particular depth. The depth is chosen to achieve maximum effectiveness in heating the substrate between the spaced apart wells, thereby to eliminate production of reservoir fluids. To facilitate hydrocarbon flow toward production well 12, the steam is introduced by way of one or more of the injection wells 11. The resulting steam front formed in reservoir 10 will thereafter progress toward the lower pressure production well 12, thereby displacing the hydrocarbon along the way.

Functionally, well head 13 at each well includes controls to facilitate the fluid flow production therethrough. The well's tubing string is selectively communicated with steam source 17 by way of a steam distribution line 20, valve 31 and well head conduit 21. The supply pressure of steam at well head 13, as noted, will of necessity exceed the pressure in the downhole environment of reservoir 10. However, in accordance with the present invention the pressure of steam at the upstream side of well head 13, need be maintained only slightly greater than the pressure realized as the stimulating steam enters tubing string 14.

Figure 2:
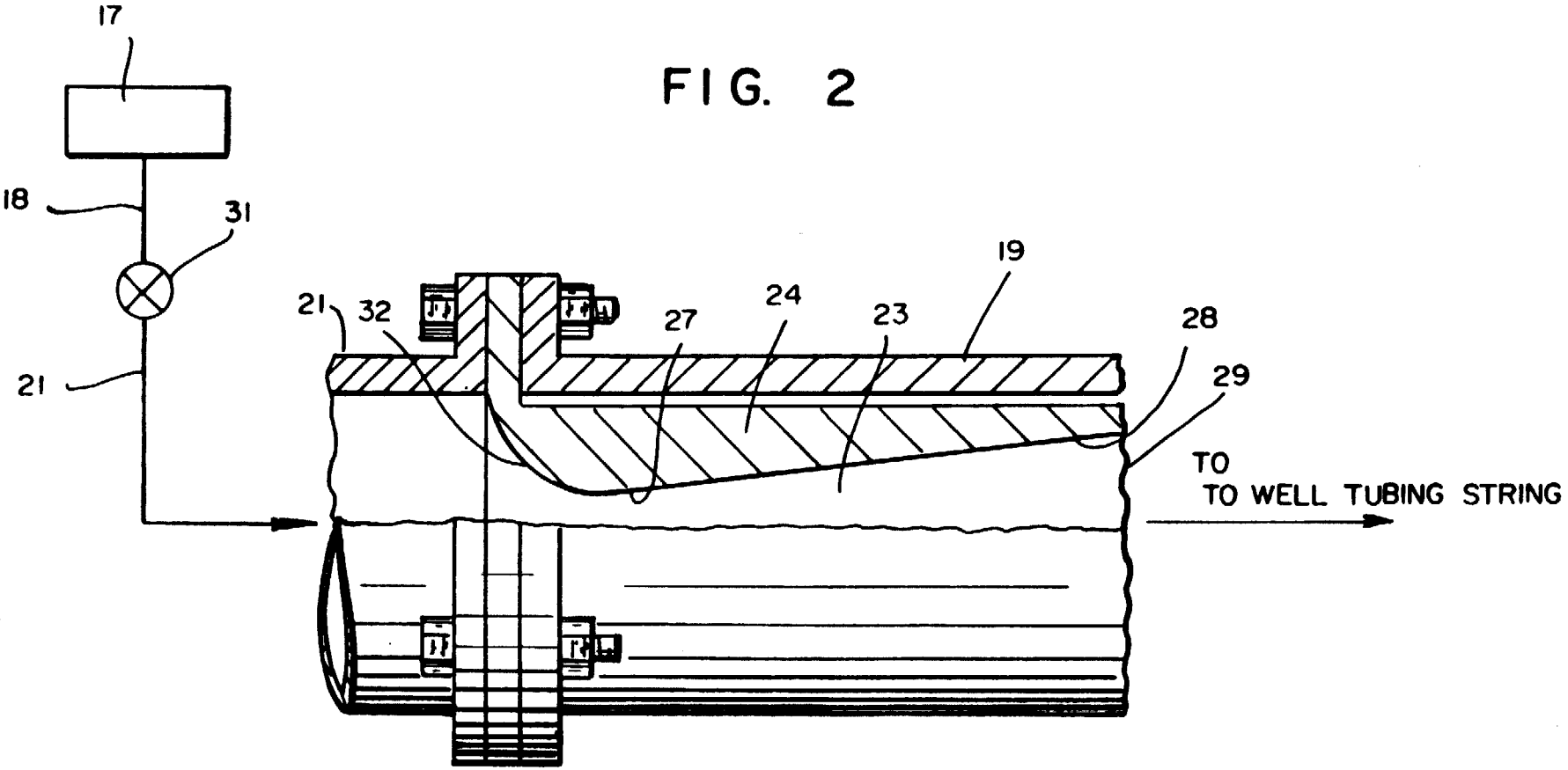
FIG. 2 is a cross-sectional view taken along line 2—2 in FIG. 1.

Referring to FIG. 2, a preferred embodiment of the novel steam flow rate control apparatus includes as a part of the steam distribution piping, a cage 19 which the latter is communicated with steam source 17 by conduit 21 through at least one flow valve 31. A critical flow venturi 24 is removably positioned in cage 19. The cage includes an inlet end communicated with steam conduit 21 to receive a controlled flow of the steam from pressurized source 17.

Critical flow venturi 24 defines an elongated, converging/diverging flow passage 23 through which the steam flow will be guided toward the upper or inlet end of the downhole pipe string 14 or the well. The critical flow venturi's inlet or converging segment, includes a nozzle 32 formed with a progressively decreasing diameter wall and terminating at a constricted throat 27.

As steam flow transverses throat 27 it enters the downstream segment 28 of the elongated flow passage 23. Downstream segment 28 is comprised of a divergent, conical nozzle formed with a relatively smooth wall surface having an internal cone angle in the range of about 2.5 to 10 degrees. The length of the divergent passage 23 in segment 26 is designed in relation to the constricted throat 27 diameter, and the steam quality. Generally, a preferred length of the divergent conical shaped segment 28 lies within the range of about 5 to 50 times throat diameter. Functionally, a longer divergent nozzle will realize better pressure recovery at lower steam qualities.

The proper selection of the throat diameter at 27 depends on the desired mass flow rate of the injected steam, which will depend in turn on the quality and pressure of the steam supplied to injection well 11. For a given venturi design, the steam flow rate generally increases in response to increase in steam pressure, and with a decrease in steam quality.

The pressure recovery (the pressure at the exit or discharge port 29 of the venturi), decreases with the reduction in steam quality and upstream pressure. As an example, at a constant steam supply pressure, the pressure recovery may fall within the order of 95% when 100% quality steam is utilized as the stimulating medium. This value will decrease to about 75% for steam quality at 20%.

Toward establishing the diameter (d) of constricted throat 27, to maintain the injected steam to a desired injected pressure, said throat is formed in accordance with the equation $$d = 9.378\sqrt{\frac{x_0^{0.435}W}{p_0}}$$

where (d) is throat diameter in inches $x_0$ is steam quality, fraction $p_0$ is stem pressure, pounds per square inch W is critical flow steam rate in pounds per second.

It is understood that although modifications and variations of the invention can be made without departing from the spirit of the scope thereof, only such limitations should be imposed as are indicated in the appended claims.

WHAT IS CLAIMED:

1. Apparatus for stimulating production of hydrocarbon fluids from a subterranean reservoir in which said fluids are retained under natural gas pressure, which subterranean reservoir is penetrated by at least one injection well and at least one hydro-carbon production well, said apparatus being comprised of a multi-segment critical venturi which includes, an upstream segment having means forming a convergent wall upstream passage which terminates at a constricted throat, inlet means in said upstream passage communicated to a pressurized source of steam to be introduced into said at least one injection well which penetrates the subterranean reservoir, a downstream segment of said multi-segment critical venturi communicated with said constricted throat to receive a flow of steam therefrom, and being characterized by a divergent wall defining a downstream passage which terminates at said at least one injection well, whereby a predetermined volumetric flow of steam from said pressurized steam source will enter said at least one injection well at a pressure not substantially less than the steam pressure at said pressurized source, said constricted throat having a cross-sectional diameter determined in accordance with the following equation:

$$d = 9.378\sqrt{\frac{x_0^{0.435}W}{p_0}}$$

where (d) is throat diameter in inches $x_0$ is steam quality, fraction po is steam pressure, pounds per square inch W is critical flow steam rate in pounds per second.

2. In the apparatus as defined claim 1 wherein said inlet means to said upstream passage is characterized by a diameter within the range of about 2–3 times greater than the diameter of said constricted throat.

3. In the apparatus as defined in claim 1 wherein said means forming said convergent wall upstream passage is characterized by a toroidial configuration.

4. In the apparatus as defined in claim 3 wherein the radius of curvature defining the convergent wall as said upstream passage is formed by a radius which is 1.82 to 0.5 times greater than the diameter of said constricted throat.

5. In the apparatus as defined in claim 1 wherein the upstream segment of said multi-segment critical venturi is characterized by an axial length between said means forming said inlet, and the constricted throat, of 1.40 to 1.75 times the diameter of said constricted throat.

6. In the apparatus as defined in claim 1 wherein the divergent wall defining said downstream passage is characterized by one angle of between about 2 to 10 degrees.

7. In the apparatus as defined in claim 1 wherein the divergent wall of said multi-segment critical flow venturi is characterized by an axial length of from 5 to 40 times the diameter of the constricted throat.

8. In the apparatus as defined in claim 1 wherein the pressure of steam introduced into said least one injection well exceeds the natural gas pressure within the subterranean reservoir.

9. Method for stimulating production of hydrocarbon fluids from a subterranean reservoir in which said fluids are retained, which method includes the step of, penetrating said subterranean reservoir with at least one production well and at least one injection well, providing said production well with a multi-segment flow control apparatus comprised of a critical flow venturi including, an upstream segment having an inlet in communication with a pressurized source of steam to be introduced into said injection well, and having a convergent wall defining a passage which terminates at a constricted throat, a downstream segment characterized by a progressively divergent, conical wall defining a downstream passage communicated with said constricted throat, and which terminates at said injection well, whereby, to deliver a flow of steam from said pressurized steam source, into said injection well, said constricted throat having a diameter established in accordance with the equation:

$$d = 9.378\sqrt{\frac{x_0^{0.435}W}{p_o}}$$

where (d) is throat diameter in inches $x_o$ is steam quality, fraction po is steam pressure, psi, and W is critical flow steam rate, in lbs. per second, and introducing a flow of steam into said means forming said inlet, introducing a flow of steam from said pressurized source thereof, to said inlet.

10. In the method as defined in claim 9 including the step of, regulating said flow of steam to ensure a critical flow thereof through said critical flow choke.

* * * * *